US006494672B1

(12) United States Patent
Khots et al.

(10) Patent No.: US 6,494,672 B1
(45) Date of Patent: Dec. 17, 2002

(54) METHOD AND APPARATUS FOR ANTISURGE CONTROL OF TURBOCOMPRESSORS HAVING COMPLEX AND CHANGING SURGE LIMIT LINES

(75) Inventors: Boris S. Khots, West Des Moines, IA (US); Leonid Shcharansky, Clive, IA (US)

(73) Assignee: Compressor Controls Corporation, Des Moines, IA (US)

( * ) Notice: Subject to any disclaimer, the term of this patent is extended or adjusted under 35 U.S.C. 154(b) by 0 days.

(21) Appl. No.: 09/326,455

(22) Filed: Jun. 7, 1999

(51) Int. Cl.[7] ..... F03B 15/00
(52) U.S. Cl. ..... 415/1; 415/17; 415/151
(58) Field of Search ..... 415/17, 58.4, 151, 415/914, 1

(56) References Cited

U.S. PATENT DOCUMENTS 5,967,742 A * 10/1999 Mirsky et al. ..... 415/1

OTHER PUBLICATIONS

Copy—5 pages—from brochure entitled Series 3 Antisurge Controller—Instruction Manual IM31 dated Oct., 1990—by Compressor Controls Corporation.

Copy—14 pages of a document entitled Compressors with Adjustable Guide Vanes by B.W. Batson—dated Nov. 26, 1996.

Copy—8 pages of a document entitled Antisurge control for variable Geometry Compressors by B.W. Batson, Ph.D./ Compressor Controls Corporation—Jun. 7, 1999.

* cited by examiner

*Primary Examiner*—Edward K. Look
*Assistant Examiner*—Kimya N McCoy
(74) *Attorney, Agent, or Firm*—Henderson & Sturm LLP

(57) ABSTRACT

Compensating for the complex changing shape and location of a turbocompressor's surge limit line can be difficult and imprecise when using antisurge controllers that do not incorporate sufficient capability. Based upon various operating conditions, surge limit line changes can be attributed to a number of process variables. These effects are particularly relevant to multistage centrifgal and axial turbocompressors operating with variable rotational speed and equipped with adjustable inlet or diffuser guide vanes, or both. This invention relates to an innovative method of antisurge control in which the function of those process variables (comprising the turbocompressor operating condition parameters) is used to calculate distances to the surge reference line. The function is formed as a superposition of the functions of lesser numbers of variables. For instance, these functions are formed as polynomials where the power of each polynomial function is determined by real characteristics of correlation between the shape and location of the surge limit line and the variables to which this polynomial function is being formed.

12 Claims, 4 Drawing Sheets

METHOD AND APPARATUS FOR ANTISURGE CONTROL OF TURBOCOMPRESSORS HAVING COMPLEX AND CHANGING SURGE LIMIT LINES

TECHNICAL FIELD

This invention relates generally to a method and apparatus for antisurge control of turbocompressors having complex and changing surge limit lines. More specifically, it relates to a method for using a function of multiple variables to describe (with high accuracy) a surge limit line under the influence of varying process conditions.

BACKGROUND ART

Antisurge controllers are designed to incorporate an approximation to compressors' surge limit lines. This approximation is referred to as the antisurge controller's surge reference line. A turbocompressor's surge limit line, in many cases, has a complex and changing shape which directly corresponds to a number of process variables with changing values; for example, guide vane position, rotational speed, isentropic exponent, and the molecular weight of the gas. This relates particularly to multistage centrifugal and axial turbocompressors equipped with adjustable inlet or diffuser guide vanes, or both.

Compensating for these complex and changing shapes consists of employing an antisurge controller to alter the surge reference line in accordance with the above mentioned process variables. However, existing antisurge controllers do not incorporate sufficient capability to fully compensate for the surge limit line's ongoing changes. This drawback results in narrowing the area of the zone (on the compressor map) in which the turbocompressor can operate with the antisurge valve closed, thereby significantly decreasing the efficiency of the turbocompressor's operation.

DISCLOSURE OF THE INVENTION

A purpose of this invention is to improve upon the prior art by providing efficient antisurge control of a turbocompressor with a surge limit line whose complex shape and location are functions of one or more process variables of a turbocompressor operation condition. This proposed control method includes describing the surge limit line with an analytic function of multiple (m) variables, $f_n(x_1, x_2, \ldots, x_{m-1}, x_m)$, that provides the following relation at the surge limit line:

$$S_s = \frac{f_n(x_1, x_2, \ldots, x_{m-1}, x_m)}{\Delta p_o / p} = 1 \tag{1}$$

where $S_s$ is a proximity-to-surge parameter; variables $x_1, x_2, \ldots, x_{m-1}, x_{m-1}, x_m$ (where 1<m)are parameters which affect the surge limit line's shape and location; $\Delta p_0$ is the differential pressure across a flow measuring device; andp is an absolute pressure. Organized in this way, the analytic function describes, with high accuracy, the complex shape and location of the surge limit line under the influence of changing conditions. This method is unlike that mentioned in the prior art, which employs the standard present-day approach for constructing the surge parameter, $S_s$, using independent functions, such as $f_1(x_1)$ and $f_2(x_2)$:

$$S_s = \frac{f_1(x_1)}{\Delta p_o / p_s} f_2(x_2), \ldots, f_{m-1}(x_{m-1}), f_m(x_m) = 1 \tag{2}$$

The emphasis of the new technique is especially directed to multistage centrifugal and axial turbocompressors operating with variable rotational speed or variable gas parameters (or both), and equipped with adjustable inlet or diffuser guide vanes (or both); although the method is not limited to this type of turbocompressor. Compensating for the complex and changing shape of a turbocompressor's surge limit line can be difficult and imprecise when using existing antisurge control methods. A typical present-day antisurge controller defines the surge parameter, $S_s$, as a measure of the relative location of a turbocompressor's operating point and its surge limit line, or as proximity-to-surge:

$$S_s = \frac{f_1(R_c)}{\Delta p_o / p} \tag{3}$$

where $f_1(R_c) = \Delta p_o / p$ when $S_s = 1$ on the surge limit line $R_c$ = pressure ratio, $p_d / p_s$ $p_d$ = absolute pressure at discharge $p_s$ = absolute pressure in suction $p$ = absolute pressure $\Delta p_o$ = differential pressure from a flow measurement device When it is necessary to compensate for influences on the surge limit line because of changes in other process variables, the influence coefficients that correlate with these variables are introduced into Eq. (3). For example, if the shape and the location of the surge limit line depend on inlet and diffuser guide-vane positions, then the appropriate coefficients of influence on the position of the inlet guide vanes ($\alpha$) and the position of the diffuser guide vanes ($\beta$) are incorporated into Eq. (3) as follows:

$$S_s = \frac{f_1(R_c)}{\Delta p_o / p} f_2(\beta) f_3(\alpha) \tag{4}$$

where $f_2(\beta)$ and $f_3(\alpha)$ are the coefficients of influence of the positions of the guide vanes. When $f_2(\beta)=f_3(\alpha)=1$ (or some arbitrary, constant value), Eq. (4) precisely describes the limit line; but when $f_2(\beta)\neq 1$ and $f_3(\alpha)\neq 1$, the precision level significantly declines. The cause of a discrepancy between the "real" new shape and location of the surge reference line and the expression of Eq. (4), is that the coefficients $f_2(\beta)$ and $f_3(\alpha)$ can only scale the function $f_1(R_c)$ which may not be congruent with the compressor's actual surge limit line. Consequently, it becomes necessary to limit the turbocompressor's operating zone where the antisurge valve can be kept closed which substantially decreases the economic efficiency of the turbocompressor's operation.

More effectual control can be achieved by the proposed method, which describes the surge reference line with an analytic function, Eq. (1). This function can be built as a superposition of functions of less than m variables. Particularly, this function can be built as a superposition of polynomial functions in which the coefficients and power of each is determined by the shape and location of the surge limit line. Formed in this way, the analytic function matches, with high accuracy, a surge limit line under the influence of changing process conditions, unlike the standard present-day approach used to construct a surge parameter.

A significant example of the proposed method involves a petrochemical process supported by a large compressor equipped with inlet and diffuser guide vanes. In order to continue the process without surge when one of two guide vanes fails, the last position of the failed guide vane must be identified, thereby allowing the antisurge controller to utilize the correct surge reference line.

BEST MODE FOR CARRYING OUT THE INVENTION

Figure 1:
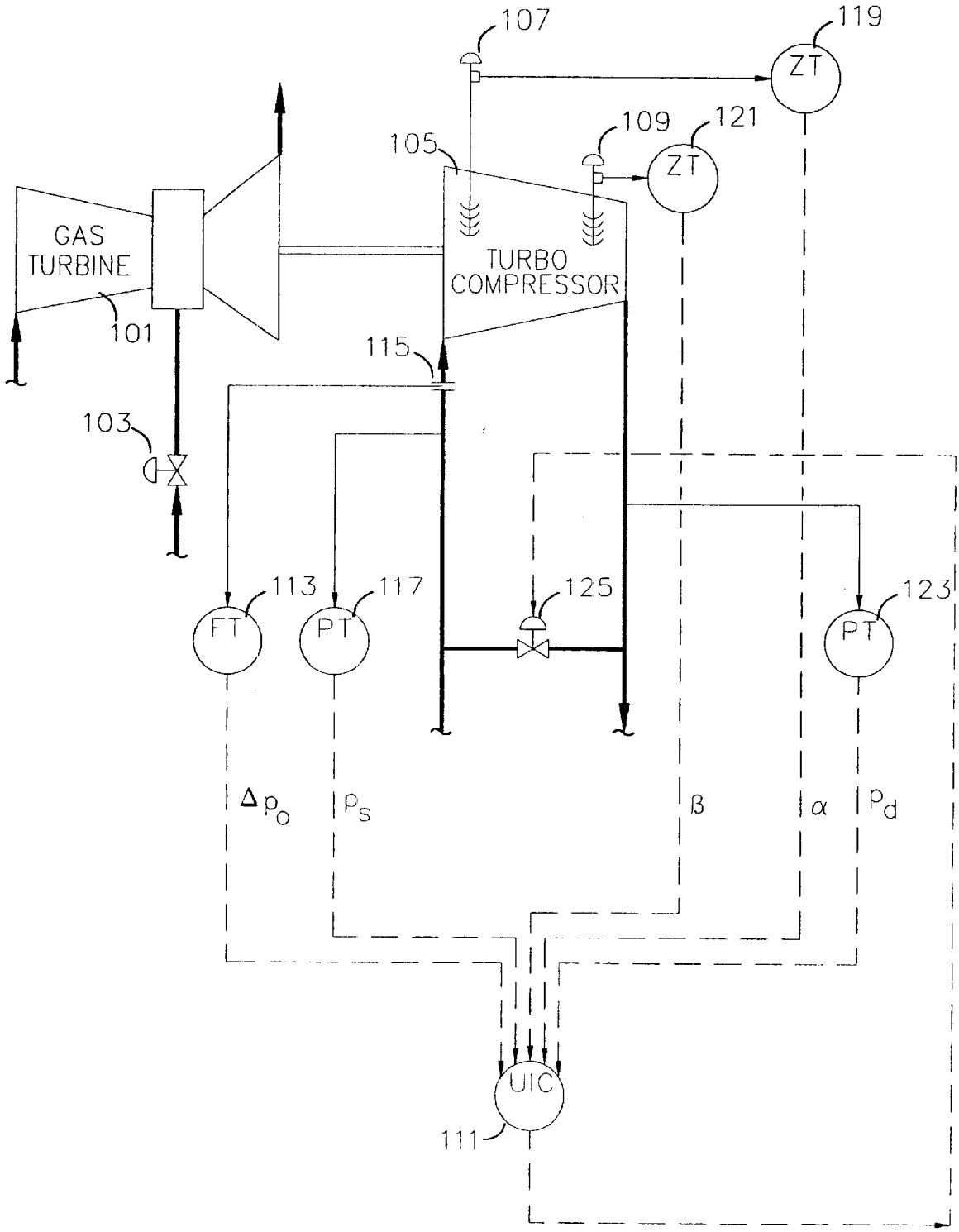
FIG. 1 shows a schematic diagram representing a turbocompressor train and control system.

The functional configuration depicted in FIG. 1 relates to a gas-pumping train consisting of a driver (gas turbine) 101 with a fuel control valve 103, and a turbocompressor 105 with inlet 107 and diffuser 109 guide vanes. The turbocompressor is equipped with an antisurge controller (UIC) 111 that receives signals from the following transmitters: differential pressure (FT–$\Delta p_o$) 113 across a flow measuring device 115, suction pressure (PT–$p_s$) 117, inlet guide-vane position (ZT–$\alpha$) 119, diffuser guide-vane position (ZT–$\beta$) 121, and discharge pressure (PT–$p_d$) 123. The UIC 111, in turn, outputs to an antisurge valve 125.

Figure 2:
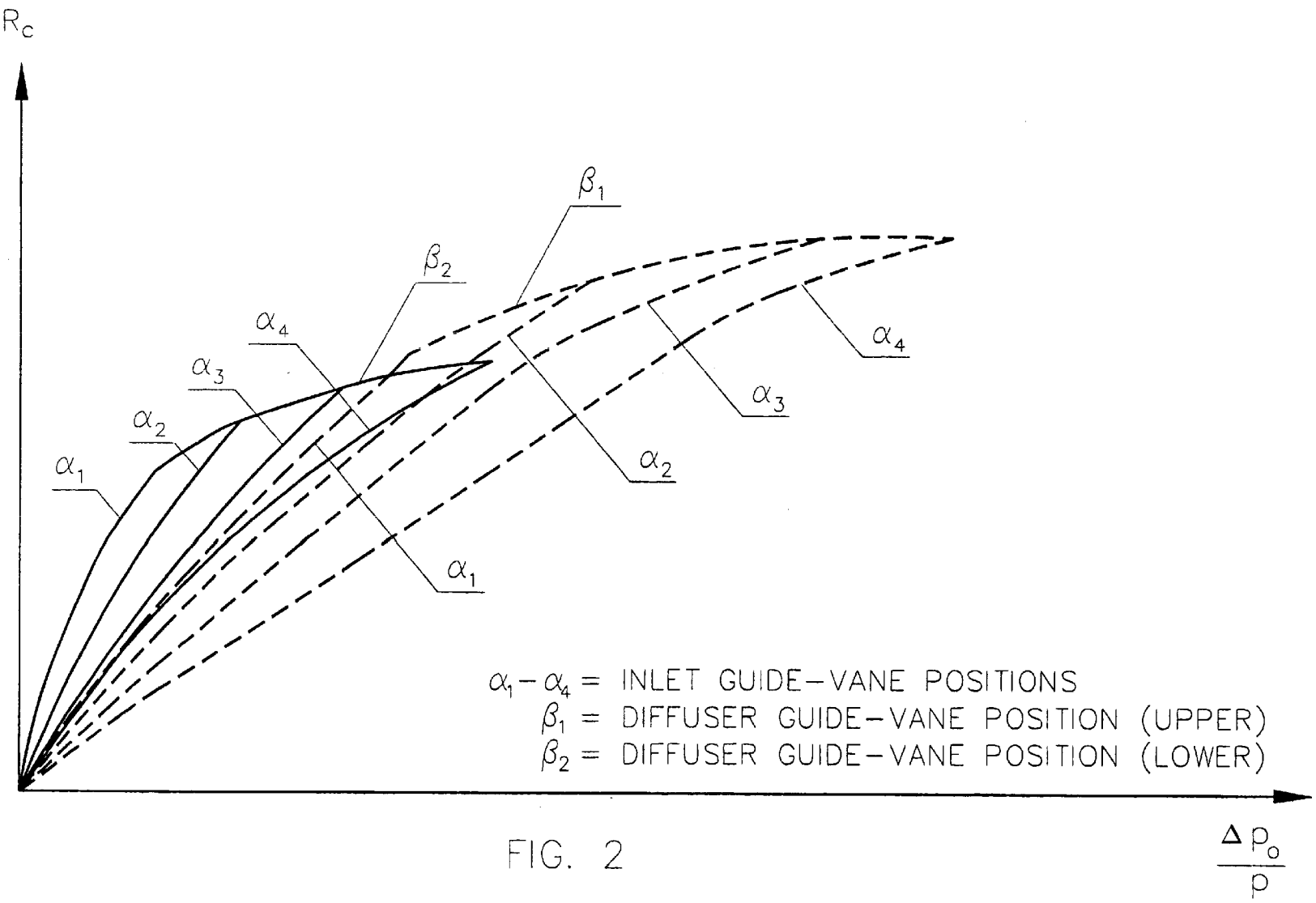
FIG. 2 shows a turbocompressor's surge limit lines on a performance map with respect to the influence of the positions of the inlet ($\alpha$) and diffuser ($\beta$) guide vanes.

FIG. 2 shows a performance map of the turbocompressor 105 with the surge limit line shown in coordinates ($\Delta p_o/p$, $R_c$), where $\alpha_1$, $\alpha_2$, $\alpha_3$, $\alpha_4$ represent the location of the surge limit line with respect to inlet guide vane 107 position (its opening is increasing from $\alpha_1$ to $\alpha_4$); and where $\beta_1$ and $\beta_2$ represent the upper and lower positions of the diffuser guide vane 109.

Figure 3:
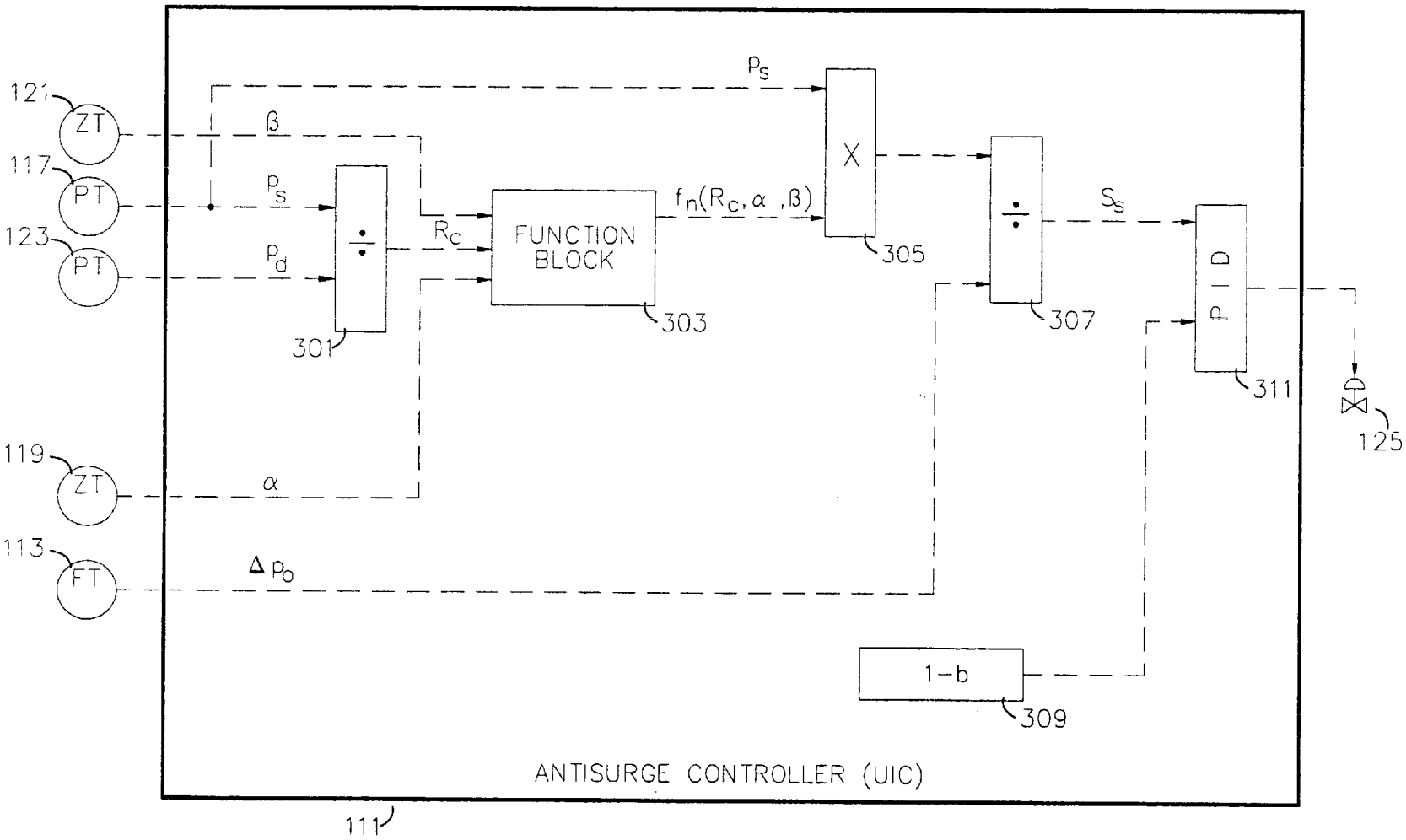
FIG. 3 shows a block diagram of an antisurge controller.

A block diagram of an antisurge controller (UIC) 111 is shown in FIG. 3 with values of suction pressure ($p_s$) 117 and discharge pressure ($P_d$) 123 being inputted to a divider 301. The $\alpha$119 and $\beta$121 signals along with a pressure ratio value ($R_c$) are transmitted to a function block 303. Suction pressure ($p_s$) and function block 303 values [$f_n(R_c, \alpha, \beta)$] are conveyed to a multiplier 305 that inputs, together with differential pressure ($\Delta p_o$) 113, to a second divider 307. The output ($S_s$) from this second divider and the output (1–b) from a set point adjuster 309 are both directed to a Proportional-Integral-Differential (PID) control algorithm 311 which, in turn, modulates an antisurge valve 125.

Figure 4:
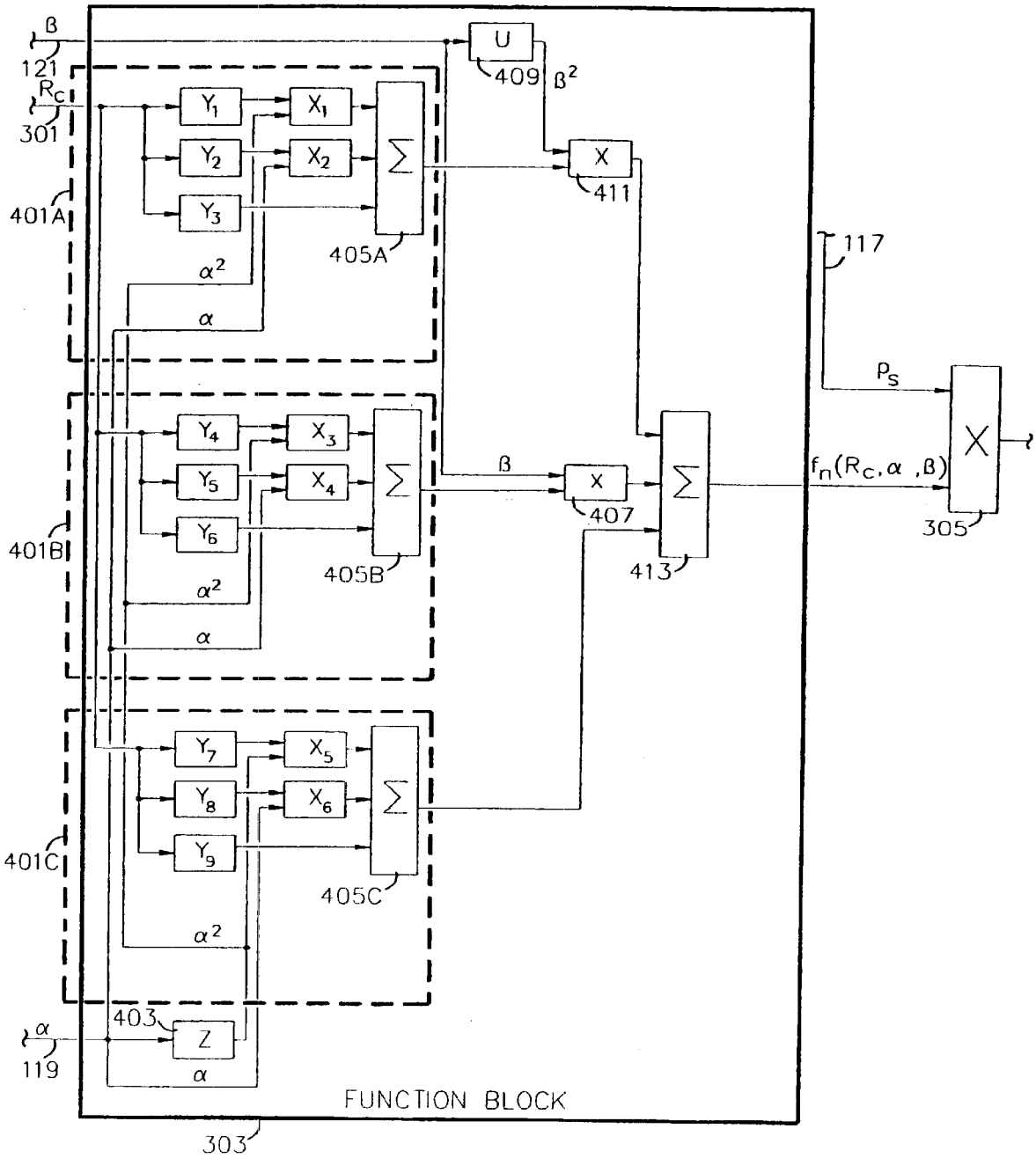
FIG. 4 shows a block diagram of a function block that calculates the values of the function $f_n(R_c, \alpha, \beta)$.

FIG. 4 shows a block diagram of the antisurge controller's fiinction block 303 (see FIG. 3) whose main components consist of three identical subfunction blocks 401A, B, C comprising the following: a total of nine $Y_j$ transducers ($Y_1$ through $Y_9$) that use the pressure ratio ($R_c$) signal 301; three multipliers ($X_2$, $X_4$, $X_6$) whose inputs are the $\alpha$119 and $R_c$ signals; three other multipliers ($X_1$, $X_3$, $X_5$) whose inputs are the $\alpha^2$ signal from a Z transducer 403 and the $R_c$ signal; and three summing blocks 405A, B,C.

The nine $Y_j$ transducers form polynomial functions based on pressure ratio ($R_c$) signals, as illustrated in the following equation, with $Y_j$ being the output signal of the $j^{th}$ transducer:

$$Y_j = a_{0j}R_c^4 + a_{1j}R_c^3 + a_{2j}R_c^2 + a_{3j}R_c + a_{4j}$$

and where $a_{ij}$ are constant coefficients. Signals from transducers $Y_1$ through $Y_9$, together with the $\alpha$ and $\alpha^2$ signals, produce three additive values 405A, B, C which are transmitted respectively to their computing blocks 411, 407, 413.

Concurrently, the incoming diffuser guide-vane ($\beta$) signal 121 inputs to a multiplier 407 and to a u transducer 409 where it is squared ($\beta^2$) and transmitted to a multiplier 411. Signals from the two foregoing multipliers 407, 411 and from the third summing block 405C are then computed in a fourth summing block 413 as a function depicted in the following example of a superposition of functions of lesser variable numbers:

$$\begin{aligned}
f_n(R_c,\alpha,\beta) = {} & [(a_{01}R_c^4 + a_{11}R_c^3 + a_{21}R_c^2 + a_{31}R_c + a_{41})\alpha^2 \\
& + (a_{02}R_c^4 + a_{12}R_c^3 + a_{22}R_c^2 + a_{32}R_c + a_{42})\alpha \\
& + (a_{03}R_c^4 + a_{13}R_c^3 + a_{23}R_c^2 + a_{33}R_c + a_{43})]\beta^2 \\
& + [(a_{04}R_c^4 + a_{14}R_c^2 + a_{24}R_c^2 + a_{34}R_c + a_{44})\alpha^2 \\
& + (a_{05}R_c^4 + a_{15}R_c^3 + a_{25}R_c^2 + a_{35}R_c + a_{45})\alpha \\
& + (a_{06}R_c^4 + a_{16}R_c^3 + a_{26}R_c^2 + a_{36}R_c + a_{46})]\beta \\
& + [(a_{07}R_c^4 + a_{17}R_c^3 + a_{27}R_c^2 + a_{37}R_c + a_{47})\alpha^2 \\
& + (a_{08}R_c^4 + a_{18}R_c^3 + a_{28}R_c^2 + a_{38}R_c + a_{48})\alpha \\
& + (a_{09}R_c^4 + a_{19}R_c^3 + a_{29}R_c^2 + a_{39}R_c + a_{49})]
\end{aligned}$$

Next, the above function, $f_n(R_c, \alpha, \beta)$, is transmitted to a multiplier 305 (see FIG. 3) where it is acted upon by a suction pressure ($p_s$) signal 117; and finally, divided by a differential pressure ($\Delta p_o$) signal 113 resulting in a proximity to the surge reference line ($S_s$) as $$S_s = \frac{f_n(R_c, \alpha, \beta)}{\Delta p_o / p_s}$$

With $S_s$ calculated and inputted along with a set point (1–b) 309 to a PID algorithm 311 that modulates an antisurge valve 125, the following condition is initiated which limits the approach of the operating point to surge:

$$S_s + b = \frac{f_n(R_c, \alpha, \beta)}{\Delta p_o / p_s} + b = 1$$

However, the antisurge valve is closed when $$S_s + b = \frac{f_n(R_c, \alpha, \beta)}{\Delta p_o / p_s} + b < 1$$

Accordingly, the antisurge controller (UIC) 111 prevents turbocompressor surging by describing a surge reference line which matches the surge limit line more precisely than controllers presently in use. The capability of this invention is accomplished for complex correlations between $f_n$ and the pressure ratio, $R_c$ (described by a polynomial function with the highest power n, where n=4); in addition to the correlation between $f_n$ and the positions of the inlet guide vane, $\alpha$, and the diffuser guide vane, $\beta$, (the influence of both variables is described by polynomial functions with the highest power of n, where n=2). Therefore, because of a more precise matching of the surge reference line to the surge limit line, the area in which a turbocompressor operates with a closed antisurge valve is widened; as a result, this operational feature promotes efficiency within the gas-pumping train and throughout the entire process.

Obviously, many modifications and variations of the present invention are possible in light of the above teachings. It is, therefore, to be understood that within the scope of the appended claims, the invention may be practiced otherwise than as specifically described. For example, the form of the functions is not limited to polynomials, but any suitable functions may be used.

We claim:

1. A method for antisurge control of a turbocompressor with a surge limit line whose complex shape and location are functions of one or more process variables of a turbocompressor's operating conditions, the method comprising:

(a) measuring and/or calculating m variables $x_1, X_2, \ldots, X_{m-1}, X_m$ (where 1<m) of the compressor operating conditions, the variables affecting the shape and location of the surge limit line;

(b) using a function of the m variables, $f_n=f_n(x_1, x_2, \ldots, X_{m-1}, X_m)$ for describing a surge reference line;

(c) calculating a relative location, $S_s$, of the turbocompressor's operating point and the surge reference line by using turbocompressor operating condition variables and the function $f_n$; and (d) utilizing the relative location, $S_s$, in an antisurge algorithm to prevent surge.

2. The method of claim 1, wherein the relative location, $S_s$, is calculated as $S_s=f_n(x_1, x_2, \ldots, x_{m-1}, x_m)/(\Delta p_o/p)$.

3. The method of claim 2, wherein the function $f_n$ is defined as the values of $\Delta p_o/p$ on the surge limit line for the given variables $x_i$.

4. The method of claim 1, wherein the function $f_n$ is a superposition of functions of fewer than m variables.

5. The method of claim 1, wherein the antisurge algorithm uses $S_s$ as a process variable with a set point of 1–b.

6. The method of claim 1, wherein the output of the antisurge algorithm is a position set point for an antisurge valve.

7. An apparatus for antisurge control of a turbocompressor with a surge limit line whose complex shape and location are functions of one or more process variables of a turbocompressor operation condition, the apparatus comprising:

(a) means for measuring and/or calculating m variables $x_1, x_2, \ldots, x_{m-1}, x_m$ (where 1<m) of the compressor operating conditions, the variables affecting the shape and location of the surge limit line;

(b) means for using a function of the m variables, $f_n=f_n(x_1, x_2, \ldots, x_{m-1}, X_m)$ for describing a surge reference line;

(c) means for calculating a relative location, $S_s$, of the turbocompressor's operating point and the surge reference line by using turbocompressor operating condition variables and the function $f_n$; and (d) an antisurge algorithm means for utilizing the relative location, $S_s$, to prevent surge.

8. The apparatus of claim 7, wherein the means for calculating the relative location, $S_s$, calculates the relative location as $S_s=f_n(x_1, x_2, \ldots, x_{m-1}, x_m)/(\Delta p_o/p)$.

9. The apparatus of claim 8, wherein the means for using the function $f_n$ defines the function as the values of $\Delta p_o/p$ on the surge limit for the given variables $x_i$.

10. The apparatus of claim 7, wherein the function $f_n$ is a superposition of functions of fewer than m variables.

11. The apparatus of claim 7, wherein the antisurge algorithm means uses $S_s$, as a process variable with a set point of 1–b.

12. The apparatus of claim 7, wherein the output of the antisurge algorithm means is a position set point for an antisurge valve.

* * * * *